US005735621A

United States Patent [19]

Shih

[11] Patent Number: 5,735,621

[45] Date of Patent: Apr. 7, 1998

[54] WRITING UTENSIL STRUCTURE

[76] Inventor: Chung-chen Shih, No. 815, Sec. 2, Changshui Rd., Tachu Li, Hsihu Chen, Changhua Hsien, Taiwan

[21] Appl. No.: 789,923

[22] Filed: Jan. 28, 1997

[51] Int. Cl.[6] ..... B43K 9/00; B43K 29/00

[52] U.S. Cl. ..... 401/52; 401/88; 401/98; 401/131; 401/195

[58] Field of Search ..... 401/131, 52, 195, 401/88, 98, 262; 446/204

[56] References Cited

U.S. PATENT DOCUMENTS

| | | | |
|---|---|---|---|
| 174,845 | 3/1876 | Park | 446/204 |
| 587,795 | 8/1897 | Crosby et al. | 446/204 |
| 2,665,945 | 1/1954 | Barton | 401/262 X |
| 3,214,780 | 11/1965 | Sharpe | 401/131 X |
| 3,234,953 | 2/1966 | Moynihan | 401/195 X |

*Primary Examiner*—Steven A. Bratlie

*Attorney, Agent, or Firm*—Oppenheimer Wolff & Donnelly LLP

[57] ABSTRACT

A writing utensil structure includes a housing having an upper end portion with a neck extending upwardly and two diametrically opposite lugs each protruding from the neck. A passage is defined in the upper end portion of the housing and extends through the neck. A cap is mounted on the upper end portion of the housing and includes an inner wall having a first recess defined in a lower portion thereof for receiving the neck, a second recess defined in an intermediate portion thereof for receiving each of the two lugs, and a third recess defined in an upper portion thereof and aligning with the passage. A writing utensil is received in the passage and has an upper end with a tip extending upwardly and received in the third recess.

4 Claims, 4 Drawing Sheets

WRITING UTENSIL STRUCTURE

FIELD OF THE INVENTION

The present invention relates to a writing utensil structure, and more particularly to a utility writing utensil structure.

BACKGROUND OF THE INVENTION

A conventional writing utensil structure is shown in FIG. 6, and there will be a complete illustration in the detailed description of the preferred embodiments.

The present invention has arisen to mitigate and/or obviate the disadvantage of the conventional writing utensil structure.

SUMMARY OF THE INVENTION

In accordance with one aspect of the present invention, there is provided a writing utensil structure comprising a housing having an upper end portion with a reduced diameter neck extending upwardly, and two diametrically opposite lugs each protruding from the neck. A passage is longitudinally defined in the upper end portion of the housing and extends through the neck.

A cap is securely mounted on the upper end portion of the housing and includes an inner wall having a first recess defined in a lower portion thereof for receiving the neck, a second recess defined in an intermediate portion thereof for receiving each of the two lugs, and a third recess defined in an upper portion thereof and aligning with the passage.

A writing utensil is received in the passage and has an upper end with a tip extending upwardly and received in the third recess.

Further features of the present invention will become apparent from a careful reading of the detailed description with appropriate reference to the accompanying drawings.

DETAILED DESCRIPTION OF TEE PREFERRED EMBODIMENTS

Figure 6:
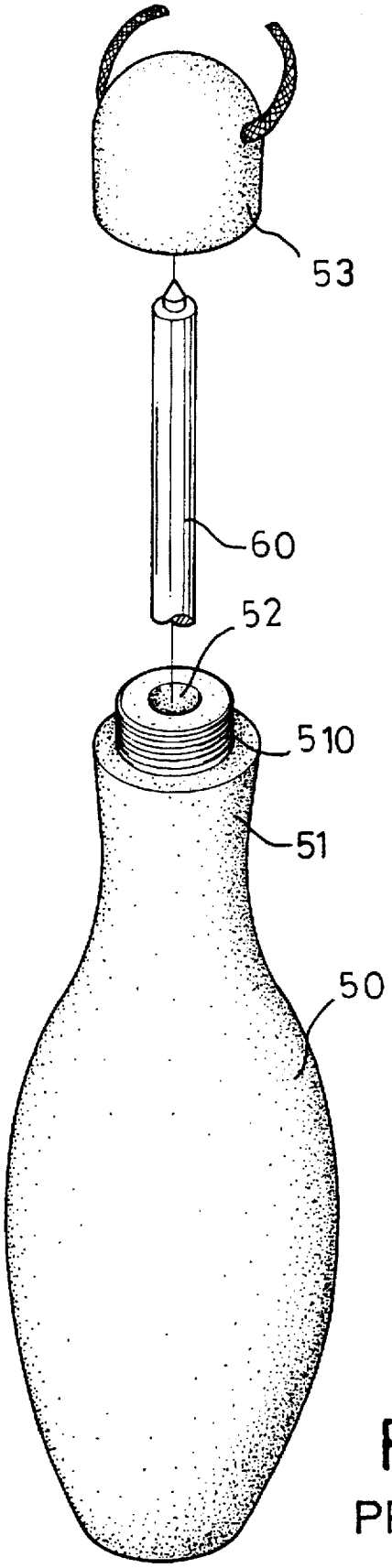
FIG. 6 PRIOR ART
FIG. 6 is an exploded view of a conventional writing utensil structure in accordance with the prior art.

For a better understanding of features and benefits of the present invention, reference is made to FIG. 6, illustrating a conventional writing utensil structure in accordance with the prior art. The conventional writing utensil structure comprises a housing 50 having an upper end portion 51 with a threaded neck 510 threadedly engaged in a cap 53, and a writing utensil 60 such as a pen, a pencil and the like received in a passage 52 defined in the housing 50.

By such an arrangement, however, the cap 53 is mounted on the housing 50 by means of a threaded engagement such that a user has to screw/unscrew the cap 53 on/from the housing 50 so as to tighten/loosen the cap 53 on/from the housing 50, thereby easily causing an inconvenience when in use, especially in a condition requiring the pen 60 to be rapidly removed from the cap 53.

In addition, the housing 50 simply functions to receive the pen 60 therein, thereby greatly limiting the versatility of the writing utensil structure.

Figure 1:
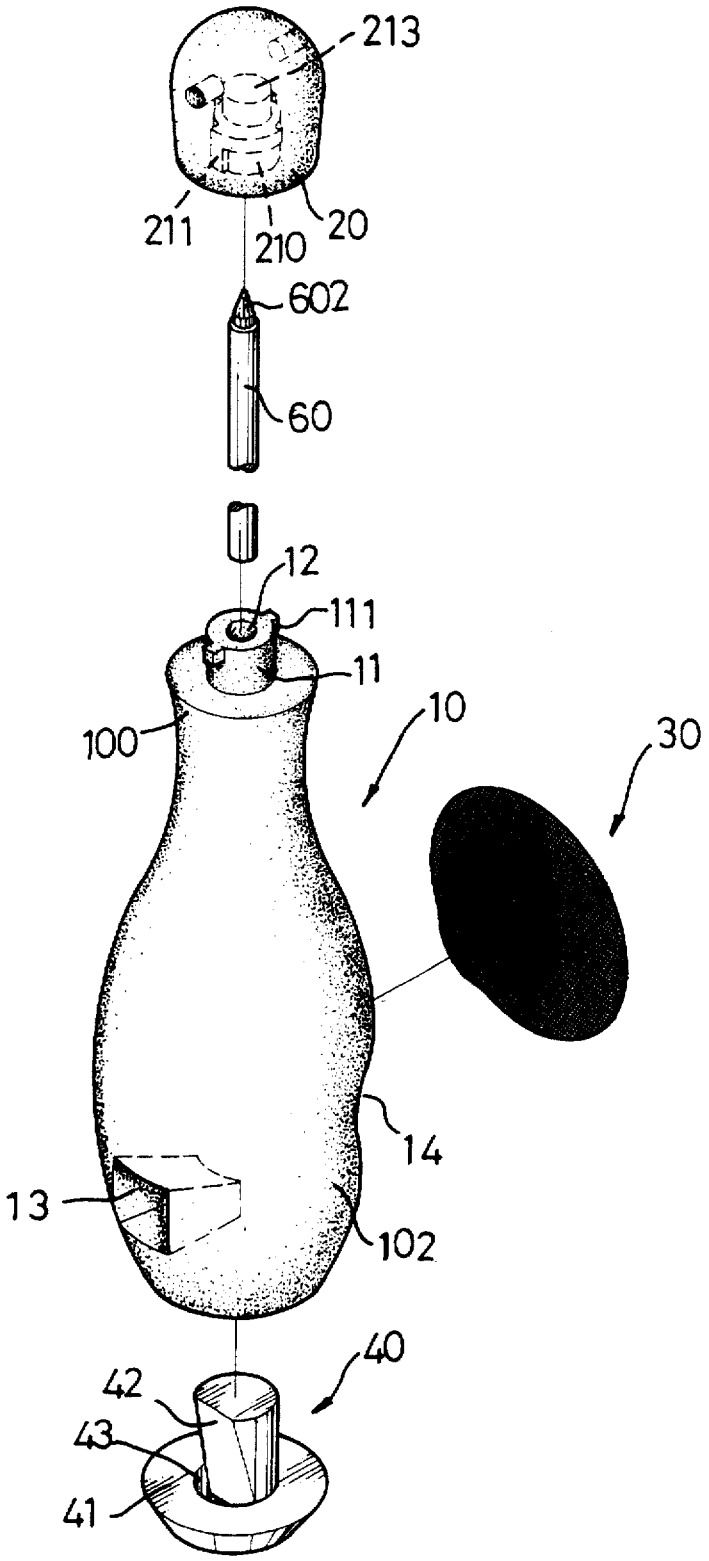
FIG. 1 is an exploded view of a writing utensil structure in accordance with the present invention.
Figure 2:
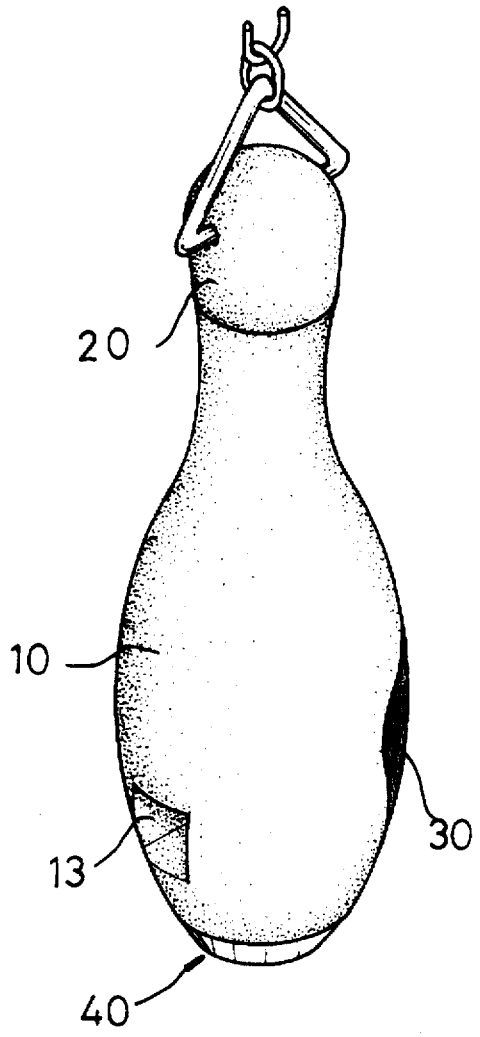
FIG. 2 is an assembly view of FIG. 1.
Figure 3:
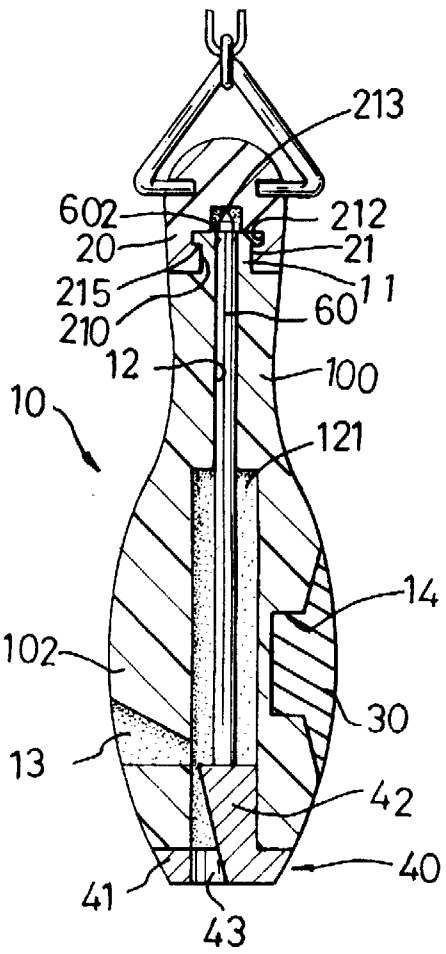
FIG. 3 is a front plan cross-sectional view of FIG. 2.

Referring now to FIGS. 1–3, a utility writing utensil structure in accordance with the present invention can provide multifunctions and comprises a housing 10 having a bowling pin configuration. The housing 10 has an upper end portion 100 with a reduced diameter neck 11 extending upwardly, and two diametrically opposite lugs 111 each protruding from the neck 11.

A passage 12 is longitudinally defined in the upper end portion 100 of the housing 10 and extends through the neck 11. An enlarged diameter chamber 121 is defined in a lower end portion 102 of the housing 10 and communicates with the passage 12.

A cap 20 is securely mounted on the upper end portion 100 of the housing 10 and includes an inner wall 21 having a first recess 210 defined in a lower portion thereof for receiving the neck 11, a second recess 212 defined in an intermediate portion thereof for receiving each of the two lugs 111, and a third recess 213 defined in an upper portion thereof and aligning with the passage 12.

The second recess 212 has a diameter greater than that of the first recess 210, and a shoulder 215 is formed between the first recess 210 and the second recess 212 for limiting each of the two lugs 111.

Two diametrically opposite cavities 211 are each defined in a periphery defining the first recess 210 and each communicate with the second recess 212 such that each of the two lugs 111 can pass through a corresponding one of the two cavities 211 into the second recess 212.

A sound diffusing opening 13 is laterally defined in the lower end portion 102 of the housing 10 and communicates with the chamber 121. A sound generating member 40 includes a cover 41 securely mounted on or attached to the lower end portion 102 of the housing 10 by means of such as an adhesive, and a sound emitting nozzle 43 defined in the cover 41 and communicating with the chamber 121.

Preferably, the sound diffusing opening 13 is disposed in a plane that is perpendicular to that of the sound emitting nozzle 43. In addition, the sound generating member 40 further includes a sound guiding wedge 42 protruding from the cover 41 to be received in the chamber 121, and located between the sound diffusing opening 13 and the sound emitting nozzle 43.

A writing utensil 60 such as a pen, a pencil or the like is received in the passage 12 and has an upper end with a tip 602 extending upwardly and received in the third recess 213, and a lower end abutting on the sound guiding wedge 42.

In operation, the cap 20 can be fitted on the upper end portion 100 of the housing 10 with each of the two lugs 111 aligning with a respective cavity 211 and being inserted into the second recess 212 via the respective cavity 211.

The cap 20 can then be rotated relative to the housing 10 such that each of the two lugs 111 misaligns with and the respective cavity 211, thereby limiting each of the two lugs 111 by the shoulder 215 and thereby securing the cap 20 on the housing 10.

The housing 10 has a well 14 laterally defined in the lower end portion 102 thereof, and a resilient plug 30 is fitted in the well 14. Preferably, the plug 30 can serve as an eraser.

In addition, a user can blow air into the chamber 121 via the sound emitting nozzle 43 and then into the sound diffusing opening 13 via the sound guiding wedge 42, thereby generating sound such that the writing utensil structure can function as a whistle.

Figure 4:
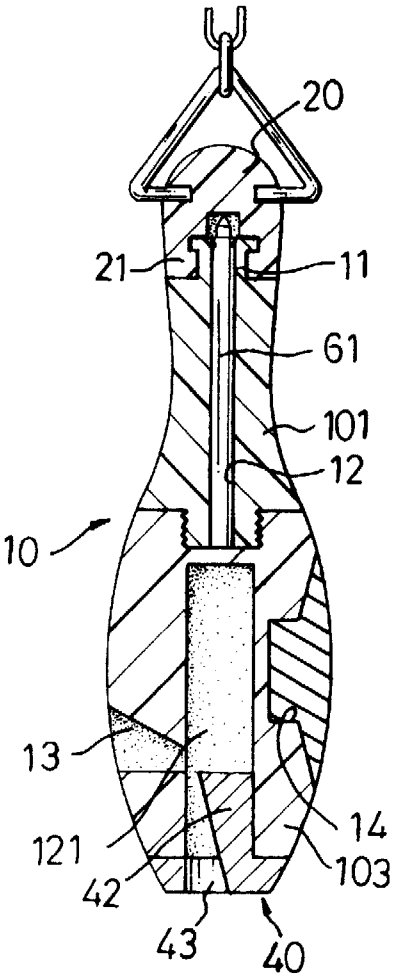
FIG. 4 is a front plan cross-sectional view according to a second embodiment of the present invention.

Referring now to FIG. 4, in accordance with a second embodiment of the present invention, the housing if includes an upper body 101 coupled with a lower body 103 by means of a threaded engagement, and the upper body 101 can be used for receiving a short writing utensil 61 therein.

Figure 5:
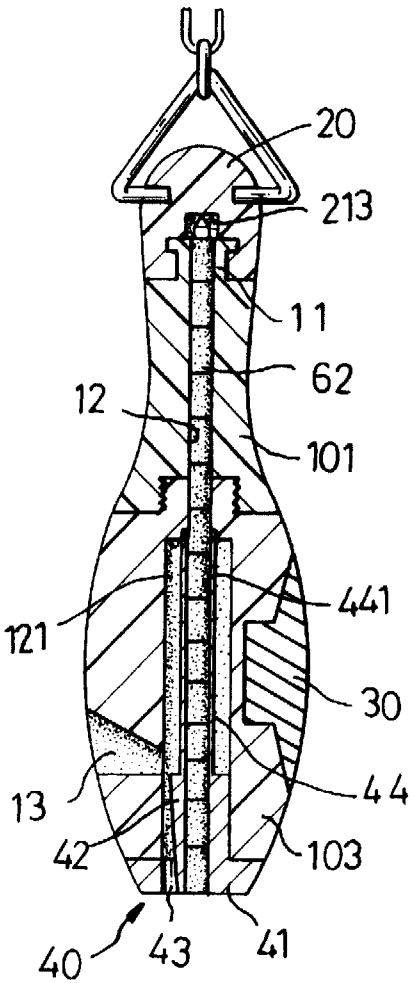
FIG. 5 is a front plan cross-sectional view according to a third embodiment of the present invention.

Referring now to FIG. 5, in accordance with a third embodiment of the present invention, the sound guiding wedge 42 has an elongate extension 44 extending upwardly with a second passage 441 defined therein for receiving an item such as a multi-noded pencil 62.

It should be clear to those skilled in the art that further embodiments of the present invention may be made without departing from the spirit and scope of the present invention.

What is claimed is:

1. A writing utensil structure comprising;

a housing having an upper end portion with a reduced diameter neck extending upwardly, and a lower end portion, two diametrically opposite lugs each protruding from said neck, a passage longitudinally defined in the upper end portion of said housing and extending through said neck, a well laterally defined in the lower end portion of said housing, and a plug fitted in said well;

a cap securely mounted on the upper end portion of said housing and including an inner wall having a first recess defined in a lower portion thereof for receiving said neck, a second recess defined in an intermediate portion thereof for receiving each of said two lugs, and a third recess defined in an upper portion thereof and aligning with said passage, two diametrically opposite cavities each defined in a periphery defining said first recess and each communicating with said second recess such that each of said two lugs can pass through a corresponding one of said two cavities into said second recess, said second recess having a diameter greater than that of said first recess, and a shoulder formed between said first recess and said second recess for limiting each of said two lugs; and a writing utensil received in said passage and having an upper end with a tip extending upwardly and received in said third recess.

2. The writing utensil structure in accordance with claim 1, wherein said housing has a chamber defined in the lower end portion thereof, an opening laterally defined in the lower end portion of said housing and communicating with said chamber, a sound generating member including a cover securely mounted on the lower end portion of said housing, and a sound emitting nozzle defined in said cover and communicating with said chamber.

3. The writing utensil structure in accordance with claim 2, wherein said opening is disposed in a plane perpendicular to that of said sound emitting nozzle.

4. The writing utensil structure in accordance with claim 2, wherein said sound generating member includes a sound guiding wedge protruding from said cover and received in said chamber and located between said opening and said sound emitting nozzle.

* * * * *